United States Patent [19]

Matsuzaki

[11] 4,278,861

[45] Jul. 14, 1981

[54] KEY BUTTON STRUCTURE FOR ELECTRONIC DEVICES

[75] Inventor: Akio Matsuzaki, Tokorozawa, Japan

[73] Assignee: Casio Computer Co., Ltd., Tokyo, Japan

[21] Appl. No.: 62,806

[22] Filed: Aug. 1, 1979

[30] Foreign Application Priority Data

Aug. 23, 1978 [JP] Japan ..... 53-115312[U]

[51] Int. Cl.[3] ..... H01H 3/12; B41J 5/12

[52] U.S. Cl. ..... 200/340; 400/490

[58] Field of Search ..... 200/159 R, 159 A, 159 B, 200/340, 5 A; 400/490, 491, 491.1, 491.2, 491.3, 495; 235/145 R

[56] References Cited

U.S. PATENT DOCUMENTS

| | | | |
|---|---|---|---|
| 631,892 | 8/1899 | Johnson | 200/DIG. 25 |
| 793,462 | 6/1905 | Munson | 400/491.1 |
| 2,059,882 | 11/1936 | Linsky | 400/491 |
| 2,981,816 | 4/1961 | Cozart | 200/159 A |
| 3,627,935 | 12/1971 | Spievak | 200/340 |
| 4,029,915 | 6/1977 | Ojima | 200/5 A |
| 4,032,729 | 6/1977 | Koistinen | 200/159 A |
| 4,066,860 | 1/1978 | Kawasaki | 200/340 |
| 4,123,641 | 10/1978 | Murata | 200/340 |

*Primary Examiner*—John W. Shepperd

*Attorney, Agent, or Firm*—Frishauf, Holtz, Goodman and Woodward

[57] ABSTRACT

In a key button structure for electronic devices, a metal plate has one or more sharp-tipped projections extending from the surface thereof. The one or more projections of the metal plate are impaled into the key button body which is made of metal, from the bottom surface of the key button body of which the area is narrower than the surface area of the metal plate, thereby to intimately couple the key button body with the metal plate. When those ports are coupled, a part of the metal plate serves as a collar.

6 Claims, 4 Drawing Figures

KEY BUTTON STRUCTURE FOR ELECTRONIC DEVICES

BACKGROUND OF THE INVENTION

The present invention relates to improvements in key buttons for use in an electronic device.

A push button switch used in a desk-top type electronic calculator and the like has a plurality of key buttons which makes contact or breaks contact through depression of the button. In these switches, the contacts are normally biased in the open condition by a release resilient body. Upon depression of the buttons, the contacts are closed.

A structure of a conventional push button type switch is illustrated in FIG. 1. As shown, a key button 2 is placed in an opening portion of an electronic calculator, being movable up and down. A resilient member 4 with an upwardly swelled portion having a downward expansion 3 which comes in contact with the bottom surface of the key button 2, is provided under the key button 2. A conductive rubber sheet 6 and an insulating sheet 7 for a movable contact are layered between the resilient member 4 and a substrate 5. The insulating sheet 7 is partly cut away right under the expansion 3 and a fixed contact 8 is fitted in this cut-away portion.

When the key button 2 is depressed, the expansion 3 presses down the conductive sheet 6 to be in contact with the fixed contact 8.

The key button 2 is provided with a collar 9 outwardly extending at the bottom end of the button 2, in order to prevent the key button from coming out of the case 1. Conventionally, the collar 9 is molded by using synthetic resin and is integral with the button 2. Alternately, a metal plate is subjected to a drawing or a rolling press working and is molded. However, the button thus formed is fragile at the collar 9 and thus is disadvantageous in its mechanical strength. For this reason, the collar 9 of the key board, which is an important factor to determine the thickness of the key board of the electronic calculator, cannot be made very thin. Therefore, it is difficult to manufacture a thin key button used for a small-sized electronic calculator which is prevailing currently in this field. Alternately, the button portion to be depressed and the collar portion are separately manufactured and these separate portions are bonded or welded. The former, however, is expensive and the latter has a poor appearance.

SUMMARY OF THE INVENTION

Accordingly, an object of the invention is to provide a key button structure for use in an electronic device which provides an extremely thin type key button by separately forming a button portion and a collar portion and by pressing the collar portion into the button portion.

To achieve the above object, a key button structure for an electronic device comprises: a key button body made of metal; and a planar, thin metal plate which forms a collar portion when it is in contact with the bottom surface of the key button body and is provided at the surface with one or more sharp-tipped projections to be impaled into the key body from the bottom surface of the key button for the purpose of intimately and firmly coupling the key button body with the metal plate.

With such a construction, a thin type key button may be realized so that, when it is used for a push button type switch for small sized electronic calculator of a now prevailing thin type, great beneficial effects are enjoyed.

BRIEF DESCRIPTION OF THE DRAWINGS

FIG. 3 is a cross sectional view of the key button shown in FIG. 2; and

FIG. 4 is a perspective view of a metal plate which forms collar portions of key buttons according to this invention.

DESCRIPTION OF THE PREFERRED EMBODIMENTS

Preferred embodiments of a structure of a key button for electronic devices will be described referring to FIGS. 2 to 4.

Figure 1:
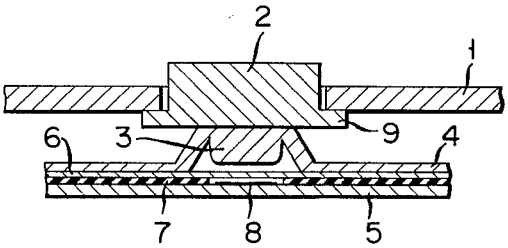
FIG. 1 PRIOR ART
FIG. 1 is a cross sectional view of the primary parts of a conventional push button type switch.
Figure 2:
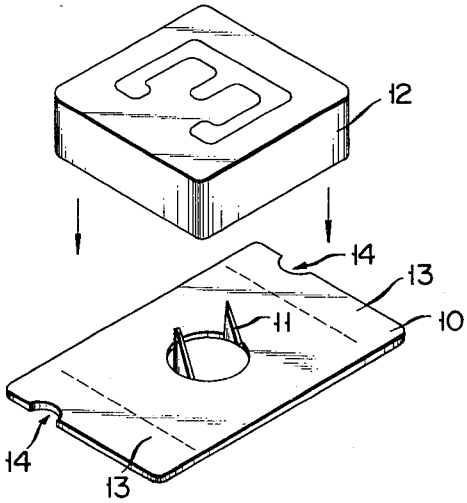
FIG. 2 is a perspective, exploded view of a key button according to this invention.

As shown in FIG. 2, a metal plate 10 with a good strength, which is made of stainless steel, for example, is slit substantially at the center to form a couple of projections 11 each having a pointed tip. A button portion 12 is made of material which is softer than that of the metal plate. Such material is aluminum, for example. On the upper surface of the button portion 2, there is depicted or engraved a character or numeral representing a function to be performed by the key operation. In this embodiment, the button has a numeral "3" depicted. When the button 12 is depressed in a direction of an arrow against the metal plate 10, the projections 11 of the metal plate 10 are impaled into the button portion 12 so that the button portion 12 and the metal plate 10 are intimately coupled, as shown in FIG. 3. Further, the metal plate 10 is pressed from the bottom thereof so that the projections 11 pressed in are slightly widened within the button portion 12. If this is done, the intimate coupling between them is further ensured. The shape of the projection 11 is not limited to that illustrated here but any shape is allowable if it ensures the intimate coupling of the plate 10 with the button 12, that is to say, it prevents the metal plate from coming off the button portion when those are coupled. To this end, the projection 11 may be provided with a formed neck portion, although it is not shown in the drawing. The surface area of the metal plate 11 is wider than the bottom area of the button 12, so that, when coupled, the metal plate 11 forms a collar 13 of the button 12. If cut-away portions 14 are formed at proper portions of the collar 13, the cut-away portions facilitates recognition of the direction of a character or numeral marked when the push button 12 is assembled into the keyboard of a calculator, for example.

Turning now to FIG. 4, there is provided another embodiment according to the invention. In this embodiment, a large single metal sheet with a plurality of plate portions 10 on which a plurality of respective buttons are arranged is punched or etched away to form collars 13 of the respective buttons. Each button section of the metal plate is punched like a U-shape, with one side remaining integral with the large sheet, as shown. When the button portion is pressed against the metal plate portions 10 with the projections 11, a collar 13 is formed. When the button is actuated, the U-shaped portion moves up and down with respect to the one side left integral with the sheet to serve as a push button switch.

The present invention is not limited to the structures mentioned above, but many modifications and variations are allowed within the scope of the invention.

What is claimed is:

1. A key button structure for electronic devices comprising:

a key button body made of a metal, said key button body having a top and a substantially flat bottom portion; and a planar, thin metal plate contacted with the bottom surface of said key button body, said thin metal plate having an area wider than the area of the bottom of said key button body and forming a collar portion relative to said key button body, said planar, thin metal plate having at least one projection having a sharp tip, the projection being bitten or impaled into the bottom of the key button body so that said key button body and said metal plate are connected together, the wider areas of said thin metal plate projecting outwardly of said key button body to form said collar.

2. A key button structure for electronic devices according to claim 1, wherein said key button body is made of a metal softer than the metal of said metal plate.

3. A key button structure for electronic devices according to claim 1, wherein said key button body is made of aluminum.

4. A key button structure for electronic devices according to claim 1, wherein said key button body has a character or numeral on the top thereof which represents a function.

5. A key button structure for electronic devices according to claim 1, wherein said metal plate has a shape to form said collar portion at least at a portion of the peripheral edge of the bottom surface of said key button body.

6. A key button structure for electronic devices according to claim 1, wherein said metal plate has a shape to form said collar around the entire outer peripheral edge of the bottom surface of said key button body.

* * * * *